US006505016B2

(12) United States Patent
Tomita

(10) Patent No.: US 6,505,016 B2
(45) Date of Patent: Jan. 7, 2003

(54) IMAGE FORMING APPARATUS INCLUDING A FIXER AND A PRESSURE APPLICATOR

(75) Inventor: Kunihiko Tomita, Hadano (JP)

(73) Assignee: Ricoh Company Limited, Tokyo (JP)

( * ) Notice: Subject to any disclaimer, the term of this patent is extended or adjusted under 35 U.S.C. 154(b) by 0 days.

(21) Appl. No.: 09/842,156

(22) Filed: Apr. 26, 2001

(65) Prior Publication Data

US 2001/0051057 A1 Dec. 13, 2001

(30) Foreign Application Priority Data

Apr. 26, 2000 (JP) ..... 2000-126174

(51) Int. Cl.[7] ..... G03G 15/20
(52) U.S. Cl. ..... 399/67; 219/216; 399/328
(58) Field of Search ..... 399/320, 328, 399/329, 67, 330; 432/60; 219/216, 469, 470, 471

(56) References Cited

U.S. PATENT DOCUMENTS

| | | | | |
|---|---|---|---|---|
| 3,948,215 A | | 4/1976 | Namiki | |
| 5,114,337 A | * | 5/1992 | Yamazaki | 219/216 |
| 5,860,051 A | * | 1/1999 | Goto et al. | 399/329 |

FOREIGN PATENT DOCUMENTS

| | | |
|---|---|---|
| EP | 0 921 448 | 6/1999 |
| JP | 51-29825 | 12/1973 |
| JP | 63-118291 | 5/1988 |
| JP | 63-118292 | 5/1988 |
| JP | 63-118293 | 5/1988 |
| JP | 4-336579 | * 11/1992 |

* cited by examiner

*Primary Examiner*—Susan S. Y. Lee
(74) *Attorney, Agent, or Firm*—Oblon, Spivak, McClelland, Maier & Neustadt, P.C.

(57) ABSTRACT

An image forming apparatus including a fixing unit configured to fix a toner image having at least one color toner and a black toner on a support upon application of heat and pressure thereto, wherein the fixing unit includes a fixer configured to heat the toner image at a first temperature not lower than a temperature at which the at least one color toner and the black toner at least soften and to cool the toner image to a second temperature lower than a temperature at which the at least one color toner and the black toner solidify while a surface of the fixer contacts the toner image, wherein the surface of the fixer has a ten-point mean roughness Rz not greater than 20 $\mu$m, and wherein the pressure P satisfies the following relationships: $((1/100)\times\log \eta_c)/15 \leqq P \leqq ((9/5)\times\log \eta_c - 4/5)/15$, and $((1/100)\times\log \eta_b)/15 \leqq P \leqq ((9/5)\times\log \eta_b - 4/5)/15$, wherein P represents the pressure in units of $9.8\times100$ N/m, and $\eta_c$ and $\eta_b$ represent viscosities of the color toner and the black toner at the first temperature in units of centi-poise, respectively.

28 Claims, 4 Drawing Sheets

IMAGE FORMING APPARATUS INCLUDING A FIXER AND A PRESSURE APPLICATOR

BACKGROUND OF THE INVENTION

1. Field of the Invention

The present invention relates to an image forming method and to an image forming apparatus, such as copiers, printers and facsimile machines, using the image forming method, and more particularly to an image fixing method of color toner images including a color toner and a black toner and to an image forming apparatus using the image fixing method.

2. Discussion of the Background

Various electrophotographic full color image forming methods using three color toners of yellow, magenta and cyan toners, or four color toners of yellow, magenta, cyan and black toners have been proposed and practically used.

When the surface of color toner images is smooth, the toner images have high gloss because the surface of the toner images reflects light like a mirror. To the contrary, when toner images have rough surface, the toner images look mat because light randomly reflects at the surface of the toner images. Therefore, when full color toner images are fixed by application of heat, the color toner images are typically fixed at a relatively high temperature to decrease the melt viscosity of the color toners constituting the color images, i.e., to prepare toner images having high gloss.

In addition, when full color images are fixed such that the melted toner images have a low melt viscosity, part of the toner images tends to adhere to the fixing element when the toner images are separated from the fixing element. Therefore the toner images tend to be broken at an inner portion of the toner image layers, i.e., the toner image layers are forcibly separated into two layers (hereinafter sometimes referred to as interlaminar separation) and an offset problem occurs in that all or part of the toner images adhered to the fixing element is re-transferred to the other area of the copy sheet or the next copy sheet. Therefore an oil is typically supplied to fixing elements to avoid such an offset problem.

In attempting to solve the offset problem, Japanese Patent Publication (hereinafter JPP) No. 51-29825 discloses an electrophotographic fixing method, and Japanese Laid-Open Patent Publications (hereinafter JOPs) Nos. 63-118291, 63-118292 and 63-118293 disclose thermal transfer methods.

In the fixing method of JPP 51-29825, a toner image to be fixed is heated at a fixing device using a film sheet, and then the toner image is cooled while the toner image adheres to the film sheet. The toner image is separated from the film sheet after the toner image is solidified. In addition, JPP 51-29825 discloses air blasting and water cooling to forcibly cool the toner image.

JOPs 63-118291, 63-118292 and 63-118293 disclose hot melt recording media which include a wax ink having a low melt viscosity and which do not cause the offset problem even when images are continuously recorded. Hot melt recording media typically include a wax in the ink as a main component. Although the melt viscosity of waxes is from 10 to $10^4$ centi-poise, the offset problem hardly occur.

Specifically, according to the technique, the offset problem can be avoided if the wax ink is melted and then cooled below a temperature at which the wax ink has a top peak value when analyzed by a differential scanning calorimeter (i.e., DSC). In particular, JOP 63-118291 discloses accelerative cooling methods using air blasting or water or freon gas. JOP 63-118292 discloses a cooling method in which the receiving material having an ink image thereon is cooled by a cooling device while the receiving material is contacted with a film sheet. JOP 63-118293 discloses a mechanism which separates the film sheet and the receiving material, and another mechanism which maintains the contact of the receiving material with the film sheet until they are separated.

According to these methods, the offset problem in that (toner) images on a receiving material adhere to a film sheet (i.e., a fixing element) can be avoided even when the images have low melt viscosity.

However, the gloss of the color images prepared by such image fixing methods is not satisfactory although the gloss is higher than general monochrome images. To the contrary, the gloss of the black toner image prepared by such image fixing methods is too high, and therefore the black image is hard to read. Therefore images having both the black and color images have low visual qualities.

In addition, when color images are fixed with a fixing roller at a temperature at which the color toners constituting the color images have low melt viscosity, an offset problem in which the color toners adhere to the fixing roller tends to occur. In addition, a release agent such as oils, is typically applied to the fixing roller to avoid the offset problem. Therefore, a release agent applying device is needed, and other problems occur, such that the image forming apparatus becomes large in size and manufacturing costs of the image forming apparatus increase.

Further, when the fixing method in which the fixing temperature is increased is used, the power consumption of the image forming apparatus increases. Therefore a requirement of low power consumption (i.e., a requirement to save energy) cannot be satisfied.

The gloss of images is often determined depending on individual preference.

Because of these reasons, a need exists for an image forming method and apparatus by which glossy color toner images (including a black image) or color toner images having glossy color images and a mat black image can be selectively obtained without causing the offset problem, without a lubricant applicator (i.e., without increasing manufacturing cost of the image forming apparatus) and without complex operations.

SUMMARY OF THE INVENTION

Accordingly, an object of the present invention is to provide an image forming method and apparatus by which glossy color toner images including a glossy black image or color toner images having glossy color images and a mat black image can be selectively obtained without causing the offset problem, without increasing manufacturing cost of the image forming apparatus and without complex operations.

Briefly this object and other objects of the present invention as hereinafter will become more readily apparent can be attained by an image forming apparatus including:

- a fixing unit configured to fix a toner image on a support having at least one color toner and a black toner upon application of heat and pressure thereto, wherein the fixing unit includes:
  - a fixer configured to heat the toner image to a first temperature not lower than a temperature at which the at least one color toner and the black toner at least soften and then cool the toner image to a second temperature lower than a temperature at which the at least one color toner and the black toner solidify while the surface of the fixer keeps contact with the toner image; and a pressure applicator configured to press the toner image toward the fixer upon application of pressure P at least when the toner image is heated at the first temperature; and wherein the surface of the fixer has a ten-point mean roughness Rz not greater than 20 $\mu$m, and wherein the pressure P satisfies the following relationships:

$$((1/100)\times log\ \eta_c)/15 \leqq P \leqq ((9/5)\times log\ \eta_c - 4/5)/15, \text{ and}$$

$$((1/100)\times log\ \eta_b)/15 \leqq P \leqq ((9/5)\times log\ \eta_b - 4/5)/15,$$

wherein P represents the pressure in units of 9.8×100 N/m, and $\eta_c$ and $\eta_b$ represent viscosities of the color toner and the black toner at the first temperature in units of centi-poise, respectively.

The viscosity $\eta_c$ of the color toner is preferably from 10 to $10^{13}$ centi-poise. The viscosity $\eta_b$ of the color toner is preferably from $10^7$ to $10^{18}$ centi-poise when forming a mat black image, and is preferably from 10 to $10^{13}$ centi-poise when forming a glossy black image.

In addition, the ratio $\eta_b/\eta_c$ is greater than 100 when forming a mat black image, and is not greater than 100 when forming a glossy black image.

The image forming apparatus preferably has a cooler configured to actively cool the toner image.

In addition, the image forming apparatus preferably has a fixing temperature controller configured to change the fixing temperature such that a combination of glossy color images and a mat black image is produced or a combination of glossy color images and a glossy black image is produced. The image forming apparatus may have a switch to choice the combination of glossy color images and a mat black image or the combination of glossy color images and a glossy black image. Alternatively, the image forming apparatus may include a printer driver which is connected with a computer and which is configured to control the fixing unit so as to produce the combination of glossy color images and a mat black image or the combination of glossy color images and a glossy black image.

In another aspect of the present invention, an image forming method including the steps of:

forming a toner image on a support, which comprises at least one color toner and a black toner each having a melting point or a softening point;

heating the toner image on the support with a fixer upon application of pressure P while the toner image contacts a surface of the fixer such that the toner image is heated at a fixing temperature not lower than the melting points or softening points of the color toner and the black toner;

then cooling the toner image to a temperature lower than the melting points or softening points while the toner image keeps contact with the surface of the fixer; and then separating the toner image on the support from the fixer, wherein the surface of the fixer has a ten-point mean roughness Rz not greater than 20 $\mu$m, and wherein the following relationship is satisfied:

$$((1/100)\times log\ \eta_c)/15 \leqq P \leqq ((9/5)\times log\ \eta_c - 4/5)/15, \text{ and}$$

$$((1/100)\times log\ \eta_b)/15 \leqq P \leqq ((9/5)\times log\ \eta_b - 4/5)/15,$$

wherein P represents the fixing pressure in units of 9.8×100 N/m, $\eta_c$ and $\eta_c$ represent the viscosity of each of the color toner and the black toner in units of centi-poise at the fixing temperature.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features end attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
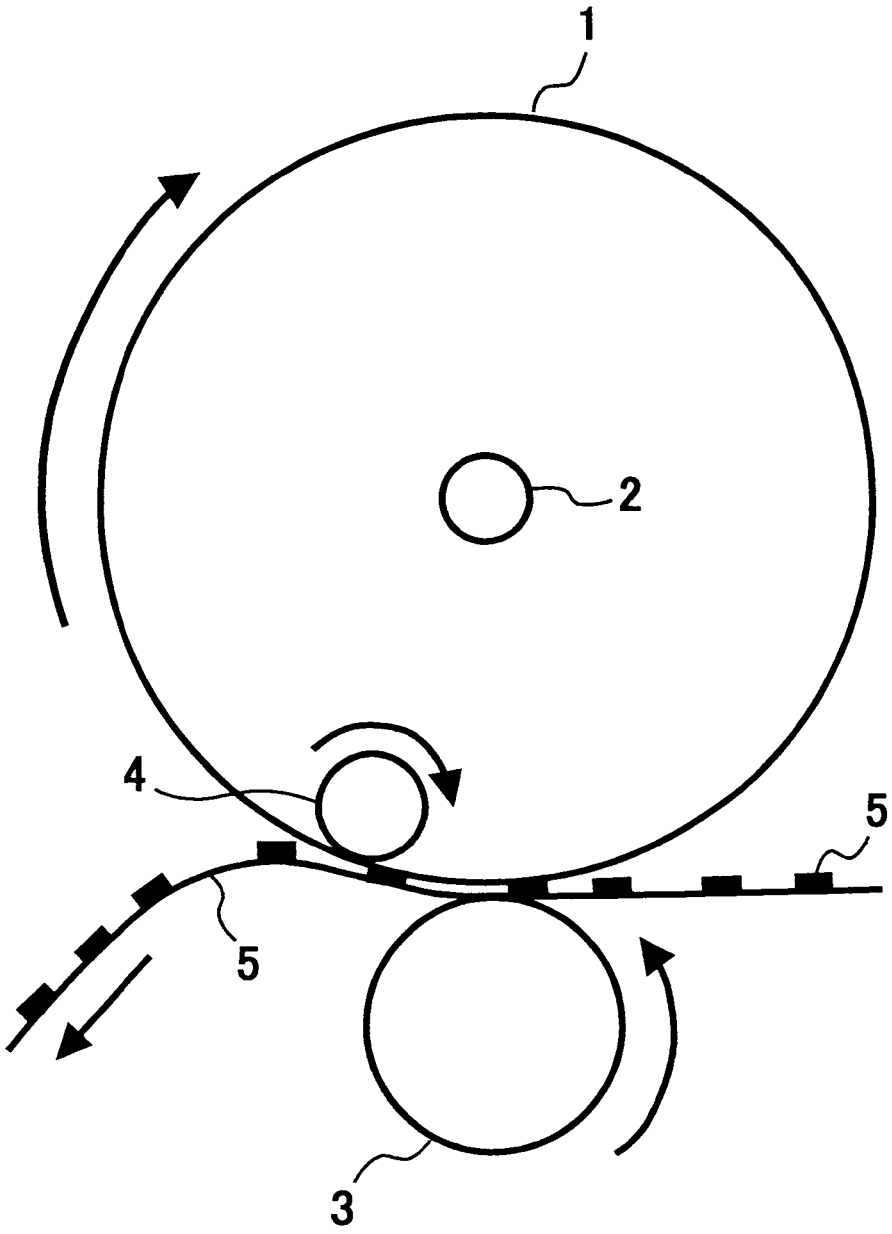
FIG. 1 is a schematic view illustrating a fixing unit for use in the image forming method and apparatus of the present invention.

FIG. 1 is a schematic view illustrating a fixing unit for use in the image forming method and apparatus of the present invention.

In FIG. 1, numerals 1, 2, 3, 4, 5 and 5*a* respectively represent a fixing roller serving as a fixing member, a heating element, a pressure roller, a cooling member, an image support and toner images including at least one color image and a black image. The fixing roller 1, pressure roller 3 and cooling member 4 rotate in the respective directions indicated by the respective arrows.

In this first embodiment, the image support 5 having the color toner images 5*a* thereon is fed to a nip between the fixing roller 1, which is heated by the heating element 2, and the pressure roller 3, to melt or soften the toner images 5*a*. The image support 5 having the toner images 5*a* is further fed while the toner images are contacting the fixing roller. Then the toner images 5*a* are cooled at a point of the surface of the fixing roller 1 at which the cooling member 4 contacts the inside of the fixing roller 1, to cool the fixing roller 1. After the toner images 5*a* are cooled such that the temperature of the toner images become lower than the melting or softening points of the toners constituting the toner images, the image support 5 having the toner images 5*a* is separated from the fixing roller 1. At this point, the surface of the fixing roller 1, with which the toner images 5*a* contact, preferably has good smoothness, i.e., a ten-point mean roughness not greater than 20 $\mu$m. In addition, the pressure P applied to the toner images by the pressure roller 3 and the fixing roller 1 satisfies the following relationship:

$$((1/100)\times log\ \eta_c)/15 \leqq P \leqq ((1/100)\times log\ \eta_c - 4/5)/15, \text{ and}$$

$$((1/100)\times log\ \eta_b)/15 \leqq P \leqq ((1/100)\times log\ \eta_b - 4/5)/15,$$

wherein P represents the fixing pressure in units of 9.8×100 N/m, $\eta_c$ and $\eta_b$ represent the viscosity of each of the color toner and the black toner in units of centi-poise at the fixing temperature.

When glossy color and black images are formed, the fixing temperature is set such that the color and black toners have viscosities in the range of from 10 to $10^{13}$ centi-poise. When glossy color images and a mat black image are formed, the fixing temperature is set such that the color toner has viscosity in the range of from 10 to $10^{13}$ centi-poise, and the black toner has viscosity of from $10^{7}$ to $10^{18}$ centi-poise.

Thus, a combination of glossy color and black images or a combination of glossy color image and a mat black image can be selectively obtained.

The cooling member 4 may be rotated or fixed, and in addition the shape thereof is not particularly limited. In addition, a cooling medium such as water may be contained in, or may flow through, the cooling member 4 to actively cool the cooling member 4, and so to actively cool the fixing roller 1.

Figure 2:
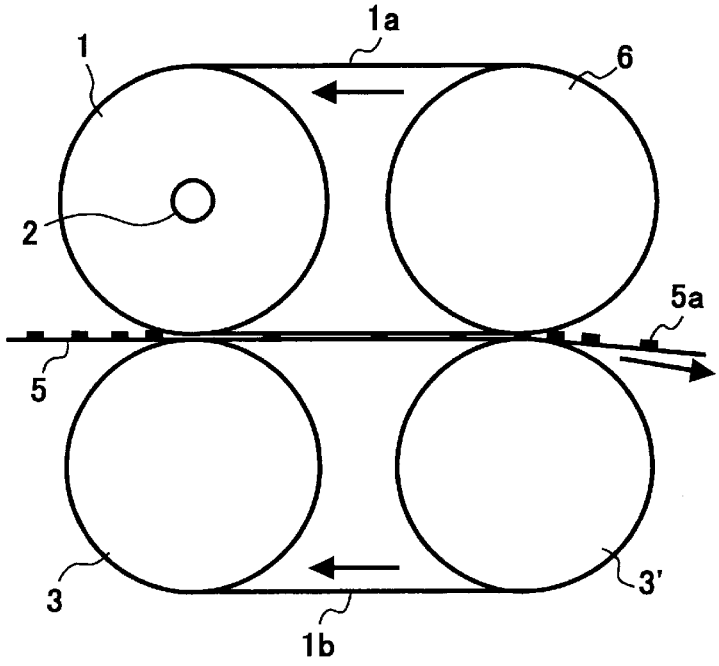
FIG. 2 is a schematic view illustrating another fixing unit for use in the image forming method and apparatus of the present invention.

FIG. 2 is a schematic view illustrating another fixing unit for use in the image forming method and apparatus of the present invention. In FIG. 2, numerals 1, 1*a* and 1*b* represent a fixing roller, a fixing belt serving as a fixing member, and a supplementary belt, respectively. Numerals 2, 3, 3', 5, 5*a* and 6 represent a heating element, a pressure roller, another pressure roller, an image support, toner images and a cooling roller, respectively. The cooling roller may include a forcible cooling means such as a flow of cooling liquid.

In this second embodiment, the endless fixing belt 1*a*, which is rotated in a direction indicated by an arrow by the fixing roller 1 and the cooling roller 6, serves as a fixing member, just as the fixing roller 1 serves as a fixing member in the first embodiment as shown in FIG. 1. In addition, the supplementary belt 1*b* is also rotated in a direction indicated by an arrow by the pressure rollers 3 and 3'. The image support 5 having the color toner images 5*a* thereon is heated to a temperature not lower than the melting points or softening points of the toners constituting the toner images at the nip between the fixing roller 1 and the pressure roller 3, namely between the fixing belt 1*a* and the supplementary belt 1*b*. The toner images 5*a* contact the surface of the fixing belt 1*a* at the nip between the fixing roller 1 end the pressure roller 3.

The image support 5 is then fed while the toner images 5*a* keep contact with the fixing belt 1*a* and the supplementary belt 1*b*. Then the color toner images 5*a* on the image support 5 are thereby cooled to a temperature lower than the melting points or softening points of the toners at the nip between the cooling roller 6 and the pressure roller 3', namely between the fixing belt 1*a* and the supplementary belt 1*b*. Then the image support 5 having a fixed toner image thereon is discharged from the fixing unit.

In the second embodiment, the pressure roller 3' and the supplementary belt 1*b* are not necessarily needed.

In addition, the toner images 5*a* may be cooled by blowing cool air thereto at a position between the fixing roller 1 and the cooling roller 6. Further, the toner images 5*a* may be naturally cooled by locating the cooling roller 6 far apart from the fixing roller 1. In these cases, the cooling roller 6 may be replaced with an uncooled roller (i.e., the cooling roller 6 does not necessarily cool the toner images 5*a* positively).

When the toner images 5*a* are cooled to a temperature lower than the melting points or softening points of the toners, the toner images 5*a* are separated from the fixing belt 1*a*. In the second embodiment, the surface of the fixing belt 1*a* to be contacted with the toner images 5*a* has good smoothness such that the ten-point mean roughness of the surface thereof is not greater than 20 $\mu$m.

In addition, the pressure applied to the toner image by the pressure roller 3 and the fixing roller 1 satisfies the above-mentioned relationship. By properly changing the fixing temperature as mentioned above, a combination of glossy color and black images or a combination of glossy color image and a mat black image can be selectively obtained.

Figure 3:
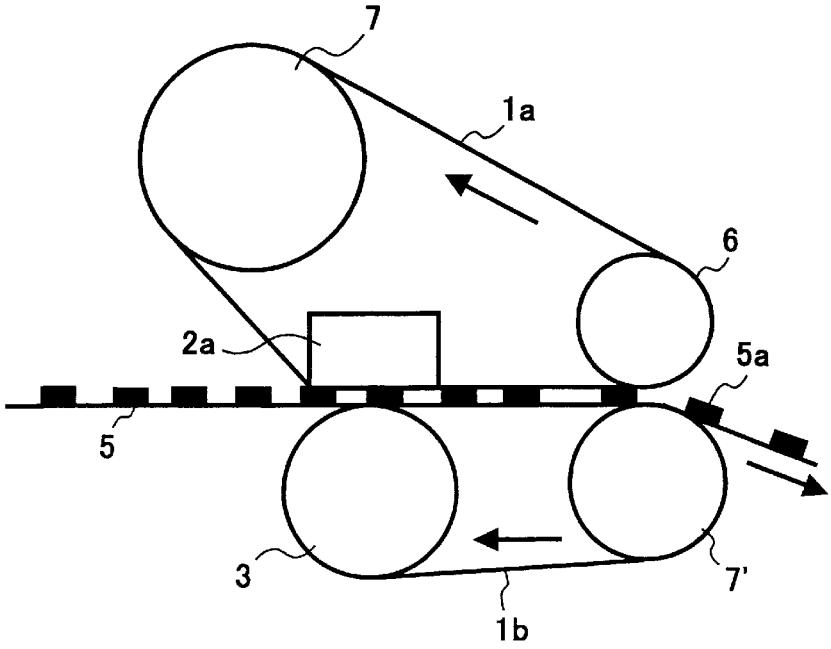
FIG. 3 is a schematic view illustrating yet another fixing unit for use in the image forming method and apparatus of the present invention.

FIG. 3 is a schematic view illustrating yet another fixing unit for use in the image forming method and apparatus of the present invention. In FIG. 3, numerals 1*a* and 1*b* represent a fixing belt and a supplementary belt, respectively. Numerals 2*a*, 3, 5, 5*a*, 6, 7 and 7' represent a linear heating element, a pressure roller, an image support, toner images, a cooling roller, a supplementary roller and another supplementary roller, respectively.

In this third embodiment, the toner images 5*a* on the image support 5 are heated by the linear heating element 2*a* with the fixing belt 1 therebetween while the image support 5 is pressed toward the linear heating element by the pressure roller 3. The image support 5 is fed by the fixing belt 1*a* and the supplemental belt 1*b*, which rotate in the respective directions indicated by the respective arrows. In FIG. 3, the supplementary roller 7' and the supplementary belt 1*b* are used, however, they are not necessarily needed. The fixing belt 1*a* is rotated by the supplementary roller 7 and the cooling roller 6. The supplementary roller 7 is not necessarily needed. In addition, as mentioned in the second embodiment, cooling of the toner images 5*a* may be performed by the method of blowing cool air to the image support 5 or by naturally cooling by locating the cooling roller 6 far apart from the linear heating element 2*a*.

When the toner images 5*a* are cooled to a temperature lower than the melting points or softening points of the toners, the toner images 5*a* are separated from the fixing belt 1*a*. In the third embodiment, the surface of the fixing belt 1*a* to be contacted with the toner images 5*a* has good smoothness such that the ten-point mean roughness of the surface is not greater than 20 $\mu$m. In addition, the pressure P applied to the toner images by the pressure roller 3 and the heating element 2*a* satisfies the above-mentioned relationship. By properly changing the fixing temperature mentioned above, a combination of glossy color and black images or a combination of glossy color images and a mat black image can be selectively obtained.

In the image forming method and apparatus of the present invention, the method of forming toner images is not particularly limited. For example, image developing methods using a dry developer such as one component developer and two component developers or toner jet developing methods can be used. In addition, wet developing methods can also be used.

Figure 4:
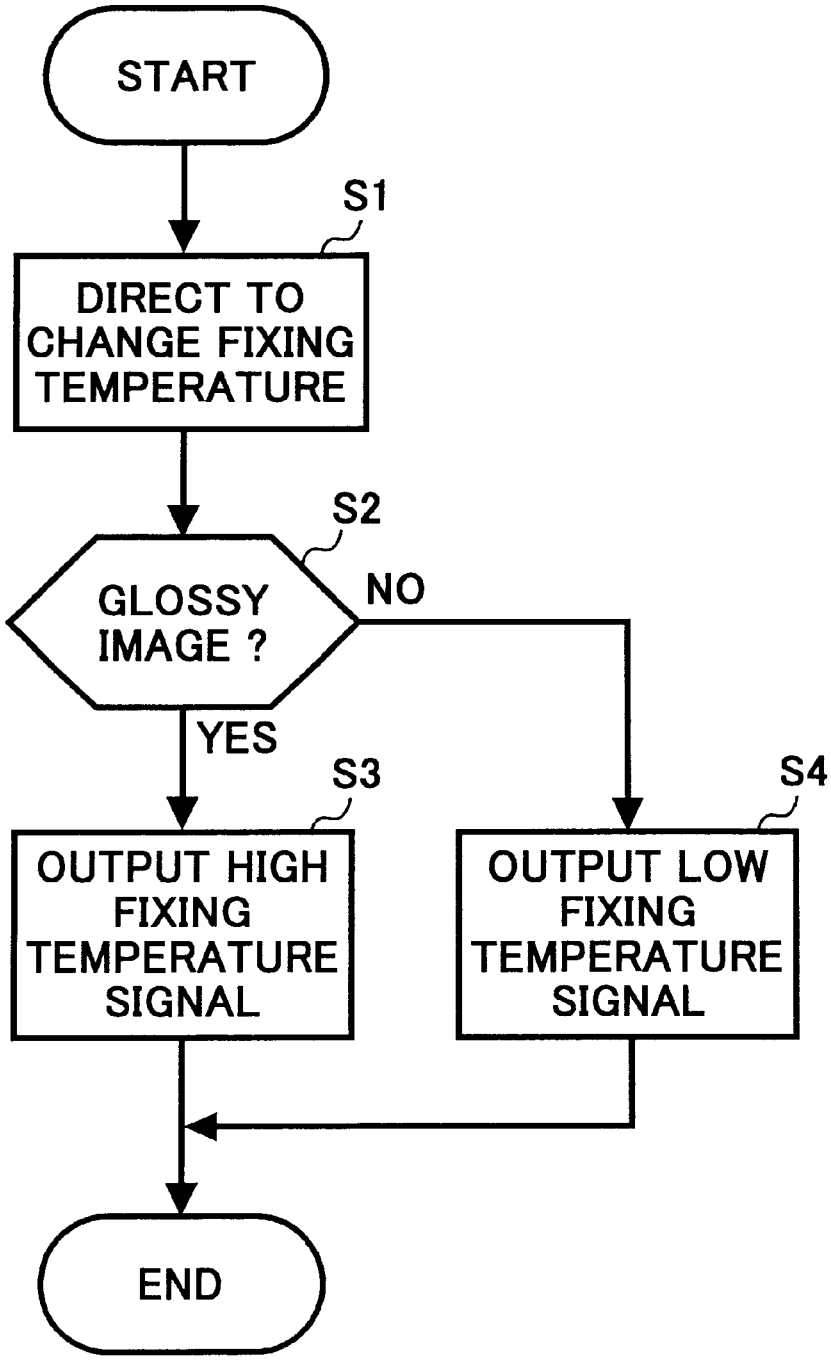
FIG. 4 is a flowchart illustrating changing the fixing temperature of the image forming apparatus of the present invention.

FIG. 4 is a flowchart illustrating the operation of the fixing temperature controller which changes the fixing temperature to change the gloss of the toner images to be produced, especially to change the gloss of the black toner images. The image forming apparatus of the present invention has a fixing unit such as the fixing units mentioned above in the first to third embodiments. In addition, the fixing temperature of the fixing unit is changed depending on the viscosities of the toners used at the fixing temperature. By changing the fixing temperature, the gloss of the black toner image can be changed, i.e., glossy black images or mat black images can be selectively produced according to the user's predilection. The selector (hereinafter referred to as a switch) by which users can change the fixing temperature is preferably easy to handle.

For example, the switch is preferably provided on an to outer surface of an image forming apparatus. The switch may be a lever switch or a toggle switch. In addition, the switch may be provide on an operation panel to control the fixing temperature using software.

In addition, the image forming apparatus may be controlled by a printer driver operated by a personal computer to select glossy black images or mat black images.

As shown in the flowchart in FIG. 4, the image forming apparatus receives a direction signal to produce glossy black images or mat black images (i.e., to change the fixing temperature) by a mechanical switch provided on the outside of the main body of the image forming apparatus or a printer driver (S1). Then it is judged (S2) whether glossy black images are produced (S3) or mat black images are produced (S4). When it is judged that glossy images are produced, the fixing temperature of the fixer is set so as to be a relatively high temperature (S3). To the contrary, when it is judged that mat images are produced, the fixing temperature of the fixer is set so as to be a relatively low temperature (S4).

In conventional fixing methods, toners having relatively low melt viscosity of from $10^7$ to $10^{13}$ centi-poise are typically used to increase the gloss of the resultant fixed toner images. In addition, an oil is applied to a fixing member used for fixing toner images to avoid the offset problem. However, when a toner having a low melt viscosity less than $10^7$ centi-poise is used, the offset problem cannot be avoided only by the method in which an oil is applied to the fixing member used.

In the present invention, even when a toner having a low melt viscosity of from 10 to $10^7$ centi-poise is used, images of the toner can be stably fixed without applying an oil to the fixing member used. Needless to say, when a toner having a melt viscosity of from $10^7$ to $10^{13}$ centi-poise is used, the toner images can be stably fixed without causing the offset problem even if an oil is not applied.

In the present invention, the viscosity means a melt viscosity when a toner is heated to a fixing temperature higher than its melting point or softening point. The softening point and melting point of a toner can be determined as the softening temperature and flow starting temperature, respectively, when thermal properties of the toner are measured using a flow tester manufactured by Shimazu Corp. In addition, the rubber state means a state in which the toner achieves a rubber-like state when heated to a temperature between its softening temperature and flow starting temperature.

In general, when a thermoplastic resin (or a toner) is heated to a temperature, the resin keeps a solid state if the temperature is less than its softening point. When the resin is further heated to a temperature higher that the softening point, the resin softens and becomes viscous. When the resin is further heated to a temperature higher then its melting point, the resin achieves a viscous liquid state. The temperature difference between the softening point and the melting point of a resin (or a toner), the viscosity of the resin at a temperature between the softening point and the melting point, and the viscosity of the resin at a temperature higher than the melting point depend on the molecular weight, molecular weight distribution, crystallinity, crosslinking degree, intermolecular force and the like properties of the resin (or the toner).

When the molecular weight of a resin is decreased, intertwining of the molecular is decreased because the molecular chain is shortened, resulting in decrease of the melt viscosity. In addition, when the molecular weight distribution is narrowed, intertwining of the molecular is also decreased because the molecular chain is shortened, resulting in decrease of the melt viscosity. Further, crosslinking degree is decreased, each molecule tends to easily move, resulting in decrease of the melt viscosity.

When a color toner having a viscosity of from 10 to $10^{13}$ centi-poise at a temperature between the softening point and the melting point is used, the fixing temperature is preferably set to be a temperature between the softening point and the melting point thereof. When a color toner having a viscosity greater than $10^{13}$ centi-poise at a temperature between the softening point and the melting point and a viscosity of from 10 to $10^{13}$ centi-poise at a temperature higher than the melting point is used, the fixing temperature is preferably set so as to be higher than the melting point thereof.

In this case, when a glossy black toner image is desired, the fixing temperature is set so as to be a temperature preferably higher than the melting point, at which the toner has a melt viscosity of from 10 to $10^{13}$ centi-poise. When a mat black toner image is desired, the fixing temperature is set so as to be a temperature, at which the toner achieves a rubber state, i.e., the toner has a viscosity of from $10^7$ to $10^{18}$ centi-poise.

As shown in the flowchart in FIG. 4, the image forming apparatus of the present invention can produce glossy black toner images or mat black toner images by changing the fixing temperature. At the same time, the color toner images have to be glossy. Therefore, the fixing temperature range of the color toner images have to overlap with both the fixing temperature range in which the black toner achieves a rubber state and the fixing temperature range in which the black toner achieves a melted state.

In view of the variation of the fixing temperature of the image forming apparatus of the present invention and the variation of environmental conditions, the temperature range in which the black color toner achieves a rubber state is preferably from 5 to 70 degree C. In addition, the temperature range in which glossy color images are obtained (i.e., the viscosity is from 10 to $10^{13}$ centi-poise) and in addition the black toner achieves a rubber state (i.e., the viscosity is from $10^7$ to $10^{18}$ centi-poise) is preferably not less than 5 degree C, to stably produce glossy color images and mat black color images. Further, the temperature range in which glossy color images are obtained and in addition the black toner achieves a melted state (i.e., the viscosity is from 10 to $10^{13}$ centi-poise) is not less than 5 degree C, to stably produce glossy color and black color images.

By the method mentioned above, the offset problem can be avoided without applying an oil to the fixing member. However, the gloss of the resultant fixed color images is not fully satisfactory. The reason is considered to be as follows. When toner images are heated upon application of pressure at a fixing portion, the toner images are easily pressed and closely adhere to the surface of the fixing member because the viscosity of the melted toner images is relatively low. When such toner images are cooled and then separated from the fixing member, the surface of the toner images has almost the same roughness as the surface of the fixing member (i.e., the surface of the toner images is embossed by the surface of the fixing member). Therefore, if the surface of the fixing member is not smooth, the gloss of the resultant fixed toner images is not satisfactory.

In addition, if the fixing pressure is too low, the surface of the toner images is roughened because the toner images cannot be fully pressed, resulting in decrease of the gloss of the toner images and deterioration of the adhesion of the toner images to the receiving material. To the contrary, toner images are pressed upon application of excessive pressure, the resultant line images are widened, resulting in deterioration of reproducibility.

As a result of the inventor's research, it is discovered that a combination of glossy color toner images and a glossy black toner image or a combination of glossy color toner images and a mat black toner image can be stably prepared under the following conditions:

(1) the surface of the fixing member used has a ten-point mean roughness not greater than 20 $\mu$m; and (2) the pressure applied to the image support having the toner images thereon by a pressure roller satisfies the following relationship:

$$((1/100)\times log\ \eta_c)/15 \leqq P \leqq ((9/5)\times log\ \eta_c - 4/5)/15, \text{ and}$$

$$((1/100)\times log\ \eta_b)/15 \leqq P \leqq ((9/5)\times log\ \eta_b - 4/5)/15,$$

wherein P represents the linear pressure in units of 9.8× 100 N/m; and $\eta_c$ and $\eta_b$ represent the melt viscosity of each of the color toner and the black toner in units of centi-poise when the toner images are heated to a fixing temperature higher than its softening point or melting point by the fixing element.

In order to obtain color images having high gloss, the surface roughness of the fixing member is preferably as small as possible. As mentioned above, since the surface of toner images is embossed by the fixing member, it is the most preferable that the surface of the fixing member has a ten-point mean roughness of 0 $\mu$m. However, there is no fixing member having such a small surface roughness. Therefore, it is preferable to control the roughness of the surface of the fixing member so as to be as small as possible, i.e., not greater than 20 $\mu$m in ten-point mean roughness Rz. Rz of the fixing member is preferably not greater than 10 $\mu$m, more preferably not greater than 5 $\mu$m, even more preferably not greater than 1 $\mu$m, and most preferably not greater than 0.1 $\mu$m.

In the present invention, a glossy image means an image having a gloss not less than 15%.

Specifically, when color toners have a relatively low melt viscosity of from 10 to $10^{13}$ centi-poise at a fixing temperature higher than the softening points or melting points of the color toners and a black toner has a relatively high viscosity of from $10^7$ to $10^{18}$ centi-poise at a fixing temperature at which the black toner achieves a rubber state, a combination of glossy color toner images and a mat black image can be obtained.

When color toners have a relatively low melt viscosity of from 10 to $10^{13}$ centi-poise at a fixing temperature higher than the softening points or melting points of the color toners and a black toner has a relatively low viscosity of from 10 to $10^{13}$ centi-poise at a fixing temperature at which the black toner achieves a melted state, a combination of glossy color toner images and a glossy black image can be obtained.

Figure 5:
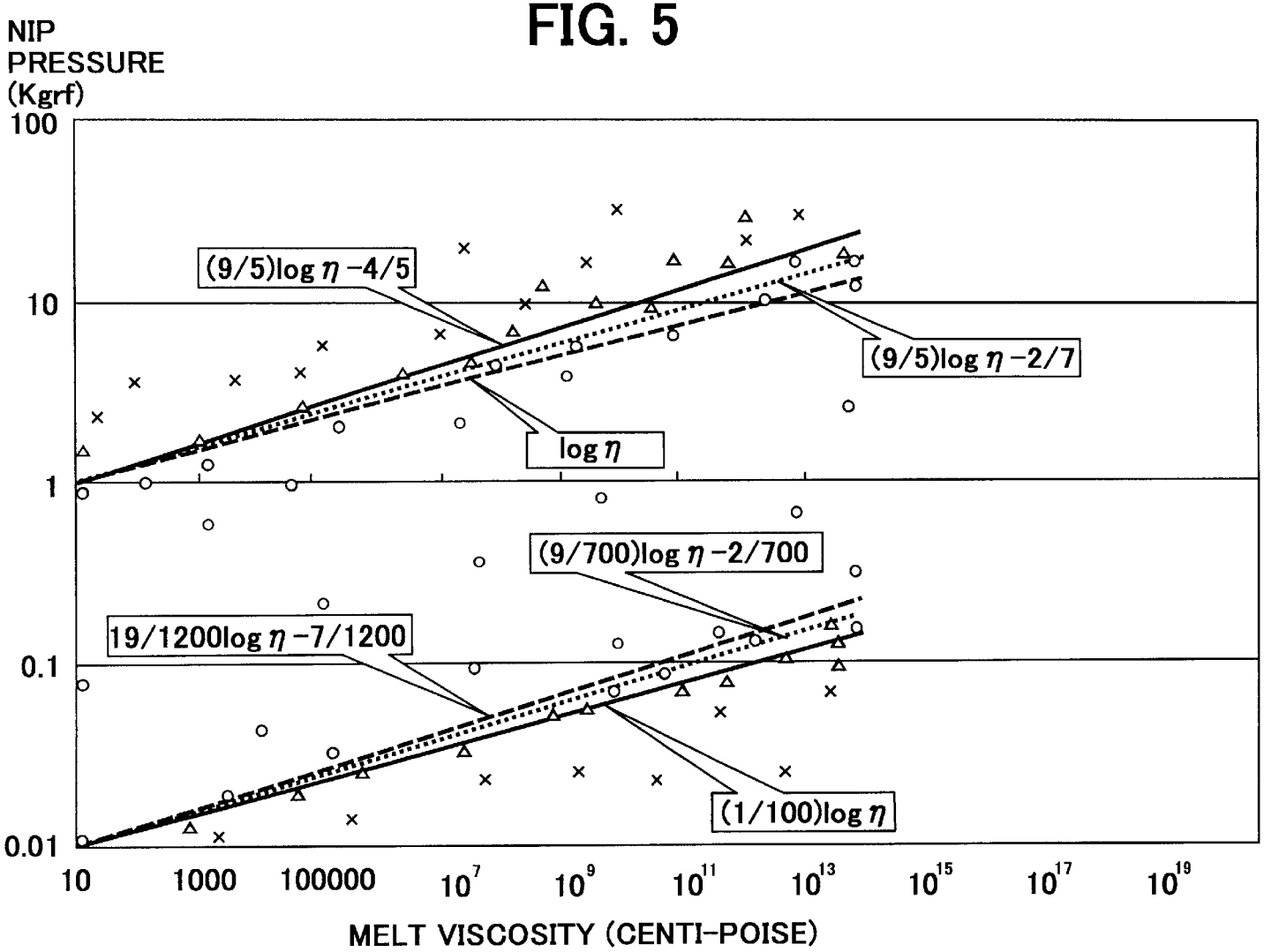
FIG. 5 is a graph illustrating the relationship among fixing pressure, melt viscosity of toner and image qualities of the fixed toner images.

As a result of the inventor's experiment in which a pressure is applied to both ends of a pressure roller while changing the level of the pressure when the viscosity of the toner is a parameter, the graph as shown in FIG. 5 is obtained. In FIG. 5, a circle mark (O) represents a fixing condition under which images having desired image qualities can be produced within the temperature/humidity conditions of from 5° C. and 10% RH to 35° C. and 80% RH.

A triangle mark (Δ) represents a fixing condition under which images having desired image qualities can be produced under room temperature and normal humidity conditions. However, the resolution of the resultant image slightly deteriorates under high temperature and high humidity conditions and the adhesion between the toner image and the image support slightly deteriorates under low temperature and low humidity conditions.

A cross mark (X) represents a fixing condition under which the resolution of the resultant image seriously deteriorates under high temperature and high humidity conditions and the adhesion between the toner image and the image support seriously deteriorates under low temperature and low humidity conditions, resulting in peeling of the toner images from the image support.

As can be understood from FIG. 5, color images having good image qualities can be produced under the conditions in the range between the two solid lines, preferably between the two dotted lines and more preferably between the two broken lines.

In FIG. 5, the pressure in the vertical axis is the pressure applied to one side of the pressure roller, and therefore the total pressure applied to the pressure roller is obtained by doubling the value. The length of the pressure roller used for the experiment is 30 cm.

As mentioned above, the linear pressure P applied to the toner images preferably satisfies the following relationship:

$$((1/100)\times log\ \eta)/15 \leqq P \leqq ((9/5)\times log\eta - 4/5)/15.$$

More preferably, the linear pressure P satisfies the following relationship:

$$((9/700)\times log\ \eta - 2/700)/15 \leqq P \leqq ((9/5)\times log\ \eta - 2/7)/15.$$

Even more preferably, the linear pressure P satisfies the following relationship:

$$((9/1200)\times log\ \eta - 7/1200)/15 \leqq P \leqq log\ \eta/15.$$

At this point, the units of the pressure P and melt viscosity are 9.8×100 N/m and centi-poise, respectively.

Thus, toner images fixed under the conditions mentioned above have a combination of glossy color and black images or a combination of glossy color images and a mat black image without deteriorating image qualities of the fixed images and the adhesion to the image support.

As the binder resin for use in the toner of the present invention, known resins is used for conventional toners can be used. Specific examples of the resins include homopolymers of styrene and substituted styrene, such as polystyrene, poly-p-chlorostyrene, polyvinyltoluene and the like; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene acrylonitrile copolymers, styrene-vinyl methyl ketone copolymers, styrene-butadiene copolymers, styrene-isoprene copolymers, styrene-acrylonitrile-indene copolymers, styrene maleic acid copolymers, styrene-malefic acid ester copolymers and the like; and other resins such as polymethyl methacrylate, polybutyl methacrylate, polyvinyl chloride, polyvinyl acetate, polyethylene, polypropylene, polyesters, polyurethane resins, polyamide resins, epoxy resins, polyvinyl butyral resins, acrylic resins, rosin, modified rosins, terpene resins, aliphatic or alicyclic hydrocarbon resins, aromatic petroleum resins, chlorinated paraffin, paraffin waxes, and the like resins. These resins are used alone or in combination.

In order to prepare a toner, one or more of these resins are mixed with a colorant, such as carbon black or color pigments or dyes. If desired, additives such as charge controlling agents may be added to the mixture. Then the mixture is kneaded upon application of heat.

The kneaded mixture is then cooled and pulverized to prepare a mother toner. The mother toner may be mixed with a fluidity improving agent such as silica, titania and strontium oxide.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Color Toners and Black Toner

Yellow, magenta, cyan and black toners having the following viscosities at 110° C. and 140° C. as shown in Table 1 were prepared.

TABLE 1

| | Viscosity at 110° C. (centi-poise) | Viscosity at 140° C. (centi-poise) |
|---|---|---|
| Yellow toner | $10^7$ | $10^5$ |
| Magenta toner | $10^7$ | $10^5$ |
| Cyan toner | $10^7$ | $10^5$ |
| Black toner | $10^{14}$ | $10^6$ |

Example 1

Color toner images formed using the yellow toner, magenta toner, cyan toner and black toner were fixed at 110° C. using the fixing device of the second embodiment of the present invention. The surface of the fixing member with which the toner images were contacted had a ten-point mean roughness Rz of 0.1 μm.

As a result, the resultant yellow, magenta and cyan images had very high gloss as shown in Table 2. The resultant black image was matted.

The gloss of the color images was measured with a gloss meter manufactured by Nippon Denshoku Kogyo K.K. by a method based on JIS Z8741. The gloss was measured by mirradiating the fixed toner images with light whose angle of the incidence was 60°.

Example 2

The procedures for preparation of the color images and black color image and evaluation in Example 1 were repeated except that the ten-point mean roughness Rz of the m surface of the fixing member was changed to 1 μm.

The results are also shown in Table 2. As a result, all the color images had very high gloss and the black toner image was matted.

Example 3

The procedures for preparation of the color images and black color image and evaluation in Example 1 were repeated except that the ten-point mean roughness Rz of the surface of the fixing member was changed to 5 μm.

The results are also shown in Table 2. As a result, all the color images had very high gloss and the black toner image was matted.

Example 4

The procedures for preparation of the color images and black color image and evaluation in Example 1 were repeated except that the ten-point mean roughness Rz of the surface of the fixing member was changed to 10 μm.

The results are also shown in Table 2. As a result, all the color images had high gloss and the black toner image was matted.

Example 5

The procedures for preparation of the color images and black color image and evaluation in Example 1 were repeated except that the ten-point mean roughness Rz of the surface of the fixing member was changed to 20 μm.

The results are also shown in Table 2. As a result, all the color images had high gloss and the black toner image was matted.

Comparative Example 1

The procedures for preparation of the color images and black color image and evaluation in Example 1 were repeated except that the ten-point mean roughness Rz of the surface of the fixing member was changed to 25 μm.

The results are also shown in Table 2. As a result, all the color images had relatively low gloss and the black toner image was matted.

Example 6

The procedures for preparation of the color images and black color image and evaluation in Example 2 were repeated except that the toner images were fixed at 140° C.

The results are also shown in Table 2. As a result, all the color toner images and the black toner image had high gloss.

Example 7

The procedures for preparation of the color images and black color image and evaluation in Example 3 were repeated except that the toner images were fixed at 140° C.

The results are also shown in Table 2. As a result, all the color toner images and the black toner image had high gloss.

TABLE 2

| | Fixing temp. changing switch | Fixing temp. (° C.) | Ten-point mean roughness (Rz) (μm) | Gloss of color images (%) | Gloss of black image (%) |
|---|---|---|---|---|---|
| Ex. 1 | Low | 110 | 0.1 | 35 | 10 |
| Ex. 2 | Low | 110 | 1 | 20 | 10 |
| Ex. 3 | Low | 110 | 5 | 18 | 10 |
| Ex. 4 | Low | 110 | 10 | 17 | 10 |
| Ex. 5 | Low | 110 | 20 | 16 | 10 |
| Comp. Ex. 1 | Low | 110 | 25 | 14 | 10 |
| Ex. 6 | High | 140 | 1 | 20 | 20 |
| Ex. 7 | High | 140 | 5 | 18 | 18 |

Preparation of Color Toners and Black Toner

Yellow, magenta, cyan and black toners having the following viscosities at 110° C. and 140° C. as shown in Table 3 were prepared.

TABLE 3

| | Viscosity at 110° C. (centi-poise) | Viscosity at 140° C. (centi-poise) |
|---|---|---|
| Yellow toner 1 | $10^7$ | $10^5$ |
| Yellow toner 2 | $10^9$ | $10^6$ |
| Yellow toner 3 | $10^{14}$ | $10^6$ |
| Magenta toner 1 | $10^7$ | $10^5$ |
| Magenta toner 2 | $10^9$ | $10^6$ |
| Magenta toner 3 | $10^{14}$ | $10^6$ |
| Cyan toner 1 | $10^7$ | $10^5$ |
| Cyan toner 2 | $10^9$ | $10^6$ |
| Cyan toner 3 | $10^{14}$ | $10^6$ |

TABLE 3-continued

| | Viscosity at 110° C. (centi-poise) | Viscosity at 140° C. (centi-poise) |
|---|---|---|
| Black toner 1 | $10^7$ | $10^5$ |
| Black toner 2 | $10^9$ | $10^6$ |
| Black toner 3 | $10^{14}$ | $10^6$ |

Example 8

Color toner images formed using the yellow toner 2, magenta toner 2, cyan toner 2 and black toner 3 were fixed at 100° C. using the fixing device of the second embodiment of the present invention. The surface of the fixing member with which the toner images were contacted had a ten-point mean roughness Rz of 0.1 μm.

As a result, the resultant yellow, magenta and cyan images had very high gloss as shown in Table 4. The resultant black image was matted.

The gloss of the color and black images was also measured with the gloss meter manufactured by Nippon Denshoku Kogyo K.K. by a method based on JIS Z8741.

Example 9

The procedures for preparation of the color images and black image and evaluation in Example 8 were repeated except that the ten-point mean roughness Rz of the surface of the fixing member was changed to 1 μm.

The results are also shown in Table 4. As a result, the resultant yellow, magenta and cyan images had very high gloss as shown in Table 4. The resultant black image was matted.

Example 10

The procedures for preparation of the color images and black image and evaluation in Example 8 were repeated except that the ten-point mean roughness Rz of the surface of the fixing member was changed to 5 μm and the yellow toner 2, magenta toner 2 and cyan toner 2 are replaced with the yellow toner 1, magenta toner 1 and cyan toner 1.

The results are also shown in Table 4. As a result, the resultant yellow, magenta and cyan images had very high gloss as shown in Table 4. The resultant black image was matted.

Example 11

The procedures for preparation of the color images and black image and evaluation in Example 10 were repeated except that the ten-point mean roughness Rz of the surface of the fixing member was changed to 10 μm.

The results are also shown in Table 4. As a result, the resultant yellow, magenta and cyan images had high gloss as shown in Table 4. The resultant black image was matted.

Example 12

The procedures for preparation of the color images and black image and evaluation in Example 8 were repeated except that the ten-point mean roughness Rz of the surface of the fixing member was changed to 20 μm.

The results are also shown in Table 4. As a result, the resultant yellow, magenta and cyan images had high gloss as shown in Table 4. The resultant black image was matted.

Comparative Example 2

The procedures for preparation of the color images and black image and evaluation in Example 8 were repeated except that the ten-point mean roughness Rz of the surface of the fixing member was changed to 25 μm and the fixing temperature was 140° C.

The results are also shown in Table 4. As a result, all the resultant yellow, magenta, cyan and black images had relatively low gloss as shown in Table 4.

Comparative Example 3

The procedures for preparation of the color images and black image and evaluation in Example 8 were repeated except that the ten-point mean roughness Rz of the surface of the fixing member was changed to 25 μm and the yellow toner 1, magenta toner 1, cyan toner 1 and black toner 2 were used instead of the yellow toner 2, magenta toner 2, cyan toner 2 and black toner 3.

The results are also shown in Table 4. As a result, all the resultant yellow, magenta, cyan and black images had relatively low gloss as shown in Table 4.

Example 13

The procedures for preparation of the color images and black image and evaluation in Example 9 were repeated except that the yellow toner 1, magenta toner 1, cyan toner 1 and black toner 1 were used instead of the yellow toner 2, magenta toner 2, cyan toner 2 and black toner 3.

The results are also shown in Table 4. As a result, all the resultant yellow, magenta, cyan and black images had high gloss as shown in Table 4.

TABLE 4

| | Rz (μm) | Gloss of color images (%) | Gloss of black image (%) |
|---|---|---|---|
| Ex. 8 | 0.1 | 35 | 10 |
| Ex. 9 | 1 | 20 | 10 |
| Ex. 10 | 5 | 18 | 10 |
| Ex. 11 | 10 | 17 | 10 |
| Ex. 12 | 20 | 16 | 10 |
| Comp. Ex. 2 | 25 | 14 | 14 |
| Comp. Ex. 3 | 25 | 14 | 14 |
| Ex. 13 | 1 | 20 | 20 |

As mentioned above, when color toner images and a black toner image are fixed at a temperature at which the color toners achieve a melted or softened state so as to have a viscosity of from 10 to $10^{13}$ centi-poise and at which the black toner achieves a rubber state so as to have a viscosity of from $10^7$ to $10^{18}$ centi-poise and greater than the viscosity of the color toners by 100 times or more, a combination of glossy color images and a mat black image can be obtained.

When color toner images and a black toner image are fixed at a temperature at which the color toners achieve a melted or softened state so as to have a viscosity of from 10 to $10^{13}$ centi-poise and at which the black toner also achieves a melted or softened state so as to have a viscosity of from 10 to $10^{13}$ centi-poise and greater than the viscosity of the color toners by 100 times or less, a combination of glossy color images and a glossy black image can be obtained.

Thus, by properly setting the fixing temperature depending on the viscosity (at the fixing temperature) of the color toners and black toner used, a combination of glossy color and black images or a combination of glossy color images and mat black image can be obtained.

In view of the variation of the softening point and melting point of the toners used and the temperature controlling ability of the fixing device used, the black toner preferably has a temperature range of not less than 5 degree C and not greater than 70 degree C in which the black toner can achieve a rubber state.

The ratio $\eta_b/\eta_c$ of the viscosity $\eta_b$ of a black toner to the viscosity $\eta_c$ of each of color toners is preferably not less than 100, preferably not less than 1000 and more preferably not less than 10000, to prepare a good combination of glossy color images and a mat black image which can be visually distinguished from the color images with respect to gloss.

By providing a fixing temperature controller in the image forming apparatus of the present invention and setting the fixing temperature depending on the viscosity at the fixing temperature of the color and black toners used, a combination of glossy color images and a glossy black image or a combination of glossy color images and a mat black image can be easily selected.

Thus, the image forming apparatus of the present invention can stably produce a combination of glossy color images and a mat black image or a combination of glossy color images and a glossy black image depending on the user's preference.

This document claims priority and contains subject matter related to Japanese Patent Application No. 2000-126174 filed on Apr. 26, 2000, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

a fixing unit configured to fix a toner image having at least one color toner and a black toner on a support upon application of heat and pressure thereto, said fixing unit comprising:

a fixer configured to heat the toner image on the support to a first temperature not lower than a temperature at which the at least one color toner and the black toner at least soften and configured to cool the toner image to a second temperature lower than a temperature at which the at least one color toner and the black toner solidify while a surface of the fixer is in contact with the toner image; and a pressure applicator configured to press the toner image toward the fixer upon application of pressure P at least when the toner image is heated at the first temperature, wherein the surface of the fixer has a ten-point mean roughness Rz not greater than 20 $\mu$m, and wherein the pressure P satisfies the following relationships:

$$((1/100)\times \log \eta_c)/15 \leqq P \leqq ((9/5)\times \log \eta_c - 4/5)/15, \text{ and}$$

$$((1/100)\times \log \eta_b)/15 \leqq P \leqq ((9/5)\times \log \eta_b - 4/5)/15,$$

wherein P represents the pressure in units of 9.8×100 N/m, and $\eta_c$ and $\eta_b$ represent viscosities of the at least one color toner and the black toner at the first temperature in units of centi-poise, respectively.

2. The image forming apparatus according to claim 1, wherein the fixer comprises:

a heater configured to heat the toner image on the support; and a feeder configured to feed the toner image on the support while a surface of the feeder contacts the toner image, wherein the heater is configured to heat the toner image contacting the surface of the feeder to the first temperature, and wherein the feeder is configured to feed the toner image heated by the heater to cool the toner image to the second temperature while remaining in contact with the toner image.

3. The image forming apparatus according to claim 2, wherein the fixer further comprises:

a cooler configured to cool the toner image heated by the heater and fed by the feeder while the feeder remains in contact with the toner image.

4. The image forming apparatus according to claim 3, wherein the feeder is a fixing roller having the heater and the cooler therein.

5. The image forming apparatus according to claim 3, wherein the feeder is an endless belt, and the cooler is a cooling roller, and wherein the endless belt is conveyed in contact along a circumferential surface of a fixing roller and the cooling roller.

6. The image forming apparatus according to claim 5, wherein the pressure applicator comprises first and second pressure rollers and a second endless belt, wherein the first pressure roller is configured to press the toner image toward the fixing roller and the second pressure roller is configured to press the toner image toward the cooling roller, and wherein the second endless belt is in contact along a circumferential surface of the first and the second pressure rollers.

7. The image forming apparatus according to claim 1, wherein the viscosity $\eta_c$ is within a range of from 10 to $10^{13}$ centi-poise, and the viscosity $\eta_b$ is in a range of from $10^7$ to $10^{18}$ centi-poise.

8. The image forming apparatus according to claim 7, wherein a ratio $\eta_b/\eta_c$ is greater than 100.

9. The image forming apparatus according to claim 7, wherein a temperature range in which the viscosity $\eta_b$ is in the range of from $10^7$ to $10^{18}$ centi-poise is from 5 to 70 degrees C.

10. The image forming apparatus according to claim 7, wherein a temperature range in which the viscosity $\eta_b$ is in the range of from $10^7$ to $10^{18}$ centi-poise and the viscosity $\eta_c$ is in the range of from 10 to $10^{13}$ centi-poise is not less than 5 degrees C.

11. The image forming apparatus according to claim 1, wherein the viscosity $\eta_c$ is in a range of from 10 to $10^{13}$ centi-poise, and the viscosity $\eta_b$ is in a range of from 10 to $10^{13}$ centi-poise.

12. The image forming apparatus according to claim 11, wherein a ratio $\eta_b/\eta_c$ is not greater than 100.

13. The image forming apparatus according to claim 11, wherein a temperature range in which the viscosity $\eta_b$ is in the range of from 10 to $10^{13}$ centi-poise is from 5 to 70 degrees C.

14. The image forming apparatus according to claim 11, wherein a temperature range in which the viscosity $\eta_b$ is in the range of from 10 to $10^{13}$ centi-poise and the viscosity $\eta_c$ is in the range of from 10 to $10^{13}$ centi-poise is not less than 5 degrees C.

15. The image forming apparatus according to claim 1, further comprising:

a first temperature controller configured to change the fixing temperature such that viscosities $\eta_c$ and $\eta_b$ are in a range of from 10 to $10^{13}$ centi-poise or the viscosity $\eta_c$ is in a range of from 10 to $10^{13}$ centi-poise and the viscosity $\eta_c$ is in a range of from $10^7$ to $10^{18}$ centi-poise.

16. The image forming apparatus according to claim 15, wherein the first temperature controller is operated by a switch provided on an outside of the image forming apparatus.

17. The image forming apparatus according to claim 15, wherein the first temperature controller is operated by an externally input signal.

18. The image forming apparatus according to claim 15, wherein the first temperature controller is a printer driver operated by a personal computer.

19. An image forming method comprising the step of:

forming a toner image on a support, wherein the toner image comprises at least one color toner and a black toner;

heating the toner image upon application of pressure P at a first temperature while the toner image contacts a surface of a fixer, wherein the first temperature is not lower than a temperature at which the at least one color toner and the black toner at least soften;

cooling the toner image to a second temperature lower than a temperature at which the at least one color toner and the black toner solidify while the toner image keeps contact with the surface of the fixer; and separating the toner image from the fixer, wherein the surface of the fixer has a ten-point mean roughness Rz not greater than 20 $\mu$m, and wherein the pressure satisfies the following relationships:

$$((1/100)\times log\ \eta_c)/15 \leqq P \leqq ((9/5)\times log\ \eta_c 4/5)/15, \text{ and}$$

$$((1/100)\times log\ \eta_b)/15 \leqq P \leqq ((9/5)\times log\ \eta_b 4/5)/15,$$

wherein P represents the pressure in units of 9.8×100 N/m, and $\eta_c$ and $\eta_b$ represent viscosities of the at least one color toner and the black toner at the first temperature in units of centi-poise, respectively.

20. The image forming method according to claim 19, wherein the viscosity $\eta_c$ is in a range of from 10 to $10^{13}$ centi-poise, and the viscosity $\eta_b$ is in a range of from $10^7$ to $10^{18}$ centi-poise.

21. The image forming method according to claim 20, wherein a ratio $\eta_b/\eta_c$ is greater than 100.

22. The image forming method according to claim 20, wherein a temperature range in which the viscosity $\eta_b$ is in the range of from $10^7$ to $10^{18}$ centi-poise is from 5 to 70 degrees C.

23. The image forming method according to claim 20, wherein a temperature range in which the viscosity $\eta_b$ is in the range of from $10^7$ to $10^{18}$ centi-poise and the viscosity $\eta_c$ is in the range of from 10 to $10^{13}$ centi-poise is not less than 5 degrees C.

24. The image forming method according to claim 19, wherein the viscosity $\eta_c$ is in a range of from 10 to $10^{13}$ centi-poise, and the viscosity $\eta_b$ is in a range of from 10 to $10^{13}$ centi-poise.

25. The image forming method according to claim 24, wherein a ratio $\eta_b/\eta_c$ is not greater than 100.

26. The image forming method according to claim 24, wherein a temperature range in which the viscosity $\eta_b$ is in the range of from 10 to $10^{13}$ centi-poise is from 5 to 70 degrees C.

27. The image forming method according to claim 24, wherein a temperature range in which the viscosity $\eta_b$ is in the range of from 10 to $10^{13}$ centi-poise and the viscosity $\eta_c$ is in the range of from 10 to $10^{13}$ centi-poise is not less than 5 degrees C.

28. A printed toner image on a support, comprising at least one color toner and a black toner, wherein the toner image is formed by heating the toner image on the support upon application of pressure at a first temperature while the image contacts a surface of a fixer, said first temperature being not lower than a temperature at which the at least one color toner and the black toner at least soften; then cooling the toner image to a second temperature lower than a temperature at which the at least one color toner and the black toner solidify while the toner image is in contact with the surface of the fixer; and separating the toner image from the fixer, and wherein the surface of the fixer has a ten-point mean roughness Rz not greater than 20 $\mu$m, and the pressure satisfies the following relationship:

$$((1/100)\times log\ \eta_c)/15 \leqq P \leqq ((9/5)\times log\ \eta_c 4/5)/15, \text{ and}$$

$$((1/100)\times log\ \eta_b)/15 \leqq P \leqq ((9/5)\times log\ \eta_b 4/5)/15,$$

wherein P represents the pressure in units of 9.8×100 N/m, and $\eta_c$ and $\eta_b$ represent viscosities of the at least one color toner and the black toner at the first temperature in units of centi-poise, respectively.

* * * * *